US005316068A

United States Patent [19]

Yagi et al.

[11] Patent Number: 5,316,068

[45] Date of Patent: May 31, 1994

[54] METHOD FOR PRODUCING CASTING WITH FUNCTIONAL GRADIENT

[75] Inventors: Wataru Yagi; Masuo Yamada; Masami Ishii; Yukuo Makimura; Tsutomu Kurikuma; Norihiro Akita, all of Aichi, Japan

[73] Assignee: Aisin Seiki Kabushiki Kaisha, Toyota, Japan

[21] Appl. No.: 909,659

[22] Filed: Jul. 7, 1992

Related U.S. Application Data

[63] Continuation of Ser. No. 800,720, Dec. 3, 1991, abandoned, which is a continuation of Ser. No. 467,505, Jan. 19, 1990, abandoned.

[30] Foreign Application Priority Data

Jan. 20, 1989 [JP] Japan ..... 1-12825

[51] Int. Cl.[5] ..... B22D 13/02; B22D 27/20

[52] U.S. Cl. ..... 164/58.1; 164/114

[58] Field of Search ..... 164/58.1, 57.1, 56.1, 164/55.1, 114

[56] References Cited

U.S. PATENT DOCUMENTS

| | | | |
|---|---|---|---|
| 358,765 | 3/1887 | Wilmington | 164/58.1 X |
| 727,103 | 5/1903 | Davis | 164/58.1 |
| 2,187,415 | 1/1940 | Daniels | 164/58.1 |
| 2,250,488 | 7/1940 | Lorig et al. | 164/58.1 X |
| 2,979,793 | 4/1961 | Wilson et al. . | |
| 3,349,831 | 10/1967 | Moore et al. | 164/58.1 |
| 3,415,307 | 12/1968 | Schuh et al. | 164/58.1 X |
| 4,058,153 | 11/1977 | Pierrel | 164/58.1 |
| 4,337,816 | 7/1982 | Kaku | 164/58.1 |
| 4,791,976 | 12/1988 | Malizio et al. | 164/58.1 |
| 4,807,728 | 2/1989 | Suenaga et al. . | |
| 4,830,656 | 5/1989 | Chalon | 164/58.1 X |

FOREIGN PATENT DOCUMENTS

| | | | |
|---|---|---|---|
| 1908856 | 12/1970 | Fed. Rep. of Germany | 164/58.1 |
| 56-111551 | 9/1981 | Japan | 164/58.1 |
| 57-91869 | 6/1982 | Japan | 164/58.1 |
| 62-110854 | 5/1987 | Japan . | |
| 62-192250 | 8/1987 | Japan . | |
| 214555 | 3/1968 | U.S.S.R. | 164/58.1 |

OTHER PUBLICATIONS

English Abstract for JP-62-110854 and JP-62-19225.

A. D. Merriman, A Dictionary of Metallurgy, "Cast Iron", MacDonald & Evans, Ltd., 1958, pp. 30-31.

*Primary Examiner*—J. Reed Batten, Jr.

*Attorney, Agent, or Firm*—Banner, Birch, McKie & Beckett

[57] ABSTRACT

A casting is produced by centrifugal casting in which molten metal of gray cast iron is poured into a cavity formed in a mold during rotation of the mold under centrifugal force. The casting comprises a gray cast iron region and a spheroidal graphite cast iron region from which the graphite structure is gradually transformed toward the gray cast iron region through an intermediate region of vermicular graphite. The spheroidal graphite region and the intermediate region are formed by a reaction of the molten metal with spheroidizing agent in the cavity during rotation of the mold and solidification of the molten metal. The spheroidizing agent is provided in the cavity to a position where the casting is to be increased in strength and abrasion resistance. The spheroidizing agent can be introduced along with the molten metal through the pouring gate into the mold cavity to a defined position of casting.

12 Claims, 3 Drawing Sheets

METHOD FOR PRODUCING CASTING WITH FUNCTIONAL GRADIENT

This application is a continuation of application Ser. No. 07/800,720, filed Dec. 3, 1991 which is a file wrapper continuation of Ser. No. 07/467,505 filed Jan. 19, 1990 and both now abandoned.

FIELD OF THE INVENTION

The present invention relates generally to castings with a functional gradient, for instance, those including different forms of graphite which is to be utilized as one of parts of, for example, a drive system of automobiles, and to a method for producing the same. More particularly, the invention relates to a casting comprised of a gray cast iron region including a distribution of flaky form graphite and a spheroidal-graphite cast iron region including a distribution of spheroidal form graphite, in which the graphite structure is gradually transformed to the gray cast iron region through an intermediate region, and to a method for producing the same.

1. Background

Castings including different regions with different forms of graphite, for example, flaky form graphite and spheroidal form graphite, have been proposed as well as a method for producing the same. For example, Japanese (Unexamined) Patent Kokai Publications Nos. 62-110854 and 62-192250 disclose a brake disk for use in a drive system of automobiles, which is made of cast iron in which two types of cast iron regions, one including the distribution of flaky form graphite and the other the distribution of spheroidal form graphite, are integrally formed with each other. As shown in FIG. 6, such a conventional brake disk comprises a hollow hub portion 12 defining therein a shaft-mounting bore 15 extending through the center axis thereof, a radially extending disk portion 11 for friction with braking pads (not shown) which is formed with heat-radiating holes 14, and a connecting portion 13 which is integrated at the lower end thereof with the inner periphery of the disk portion 11 and at the upper end portion thereof with the upper end of the hub portion. The hub portion 12 is made in the form of spheroidal graphite cast iron (may be referred to as "FCD" hereinafter) or compacted/vermicular graphite cast iron (may be referred to as "CV" hereinafter) which has an increased mechanical strength, while the disk portion 11 is made in the form of high-dumping flaky graphite cast iron (referred to as "FCHD" hereinafter) by a centrifugal casting method utilizing a rotating casting mold so that the disk portion can be formed in the form of a high-dumping gray cast iron (FCHD), with the existence of a boundary surface A between FCHD and FCD or CV.

FIG. 7 shows a conventional casting apparatus for producing the above-mentioned brake disk, in which a casting mold 16 comprised of an upper mold 20 and a lower mold 21 is adapted to be rotated together with a rotary shaft 18 about a vertical center axis 17 thereof at a high speed, in order to perform centrifugal casting. The casting mold 16 defines a central cavity portion 24 for forming the hub portion 12 of the brake disk, a radially outward cavity portion 23 for forming the disk portion 11 of the disk, and a connecting cavity portion 27 for forming the connecting portion 13 of the disk, which together form a single continuous cavity connected to a central portion gate 26 and a peripheral sprue 22. When the mold 16 remains stationary, the molten liquid of FCHD is poured into the cavity portion 23 through the peripheral sprue 22 and maintained therein for stabilizing the level thereof. After a predetermined time lag, the molten metal of FCD or CV is poured into the central cavity portion of the mold through the pouring gate 25 and a central pouring passage 26. Thereafter, the mold 16 is rotated at a high speed so as to fuse together and molten FCHD and the molten FC or CV at a boundary surface A, as shown in FIG. 6, during solidification of these molten metals.

2. Discussion of the Prior Art

However, the above-described conventional rotary casting method has the following disadvantages:

(1) Individual two steps for pouring different types of molten metals are required to produce one casting, resulting in the increase of the number of steps for the production of casting.

(2) Although it is desirable to form a greater interface between the solidified regions or layers along a direction parallel to the center axis of the casting, it is difficult to control the pouring time of respective types of molten metals, time lag, timing of beginning of rotation of the mold, and the rotation speed thereof, resulting in the deterioration of quality control among lots.

(3) Production of an undesirable oxide scale on the inner surface of the outer layer or a thin chilled shell, formed at the interface with the outer layer, of the inner layer due to an excessive time lag between the two pouring processes makes it difficult to ensure a sufficient joint of the outer and inner layers. On the other hand, when the time lag is too short, the contents of the inner layer are tend to be mixed with the outer layer due to insufficient solidification of the outer layer, resulting in the reduction of thickness of the outer layer, which makes it difficult to control the thickness of the layer.

(4) It is difficult to ensure a balanced rotation of the mold due to existence of eccentric outer pouring gate.

(5) Misrun tends to occur due to complexity of the mold cavity.

SUMMARY OF THE INVENTION

Therefore, an object of the present invention is to provide a casting with the functional gradient, e.g., one in which the spheroidal graphite cast iron region is gradually transformed at the interface thereof into a gray cast iron region through an intermediate region and in which only necessary portion(s) thereof is (are) increased in mechanical strength, hardness and/or abrasion resistance by the use of a single pouring process of molten metal.

Another object of the invention is to provide a method for producing a casting with the functional gradient in which only necessary portion thereof is increased in at least one property (e.g., mechanical strength, hardness and/or abrasion resistance) by the use of a single pouring process of a molten metal.

According to a first aspect of the present invention said object can be achieved by a casting produced by centrifugal casting in which, molten metal of gray cast iron is poured into a cavity formed in a mold during rotation of the mold under the centrifugal force, which casting comprises:

a gray cast iron region mainly containing flaky graphite;

a spheroidal graphite cast iron region (referred to as "spheroidal graphite region"), and an intermediate region mainly containing vermicular graphite disposed between the gray cast iron region and the spheroidal graphite region, said spheroidal graphite region and said intermediate region having been formed by reaction of the molten metal with a spheroidizing agent in said cavity during rotation of said mold and solidification of the molten metal.

Typically the spheroidal graphite region is disposed at the outer periphery of casting of a disk-like form, with the gray cast iron region being at the central part of the casting, vice versa. Further different arrangements of the structural regions may be possible.

The alloy structure is gradually transformed from the spheroidal graphite region toward the gray cast iron region through the intermediate (boundary) region containing the vermicular form graphite. The spheroidal graphite region and the boundary region are formed by reaction of the molten metal with spheroidizing agent in the cavity during rotation of the mold and solidification of the molten metal. Thus there is no "joint" or interface between the neighboring regions of different graphite structures, and the change in the graphite structure regions is continuous. This structure assures a high strength and uniformity of the casting.

According to a second aspect of the present invention, the object of the invention can be achieved by a method for producing a casting as mentioned in the first aspect, which method comprises the steps of:

providing a mold rotatable about a center axis thereof, the mold being formed therein with a cavity for receiving molten metal of gray cast iron, through a pouring gate formed in the mold;

providing a spheroidizing agent in the cavity to a position of casting where the casting is to be changed in at least one property, before pouring the molten metal;

pouring the molten metal into the cavity of the mold through the pouring gate while rotating the mold; and allowing the molten metal to solidify in the cavity while rotating the mold so as to react the molten metal with the spheroidizing agent under the centrifugal force produced in accordance with the rotation of the mold.

According to a third aspect of the present invention the object of the invention can also be achieved by a method for producing a casting as mentioned in the first aspect comprising the steps of:

providing a mold rotatable about a center axis thereof, the mold being formed therein with a cavity for receiving molten metal of gray cast iron through a pouring gate formed in the mold;

pouring the molten metal into the cavity of the mold through a pouring gate while rotating the mold;

providing a spheroidizing agent along with the molten metal through the pouring gate to a position in the cavity of the mold where a casting is to be changed in at least one property at a defined partial period of time during the pouring;

allowing the molten metal to solidify in the cavity while rotating the mold so as to react the molten metal with the spheroidizing agent under centrifugal force produced in accordance with the rotation of the mold.

PREFERRED EMBODIMENTS

In the second and third aspects, the pouring is effected, typically through a pouring gate located at the center of the mold.

The molten metal preferably has high C and Si contents, as well as additional Mn, Ni and Cu, each of which serves to control the matrix structure of the molten metal. The spheroidizing agent is used for spheroidizing the graphite in the gray cast iron.

Preferably, the spheroidizing agent, according to the invention, includes grains which are made of pure Mg or alloy of Ni-Mg, Cu-Mg or Fe-Si-Mg system and which are regulated to have a particle size within the range from 5 to 50 mesh. More preferably, the spheroidizing agent includes powders which are made of alloy of Fe-Si-Mg system having a Mg content of 4 to 6 weight percent and which are regulated to have a particle size within the range from 5 to 50 mesh. Rare earth metals may be added into the spheroidizing agent (Fe-Si-Mg alloy).

The spheroidizing agent supplied in the cavity, according to the invention, is preferably 0.2 to 0.8 weight-percent (calculated on Mg) of the molten metal in the cavity.

In the present invention, the mold is preferably preheated at 100° to 500° C. when the molten metal having a pouring temperature within the range from 1350° to 1550° C., preferably more than 1450° C., is poured into the cavity.

Further, the mold is preferably rotated at such a speed as to produce centrifugal force number from 0G to 1000G.

In the multi-cast iron structure of the casting produced in accordance with the present invention, the spheroidal graphite cast iron (FCD) region mainly includes a distribution of spheroidal graphite, while the vermicular graphite cast iron (CV) region mainly includes a vermicular form graphite and the gray cast iron (FC) region mainly includes a distribution of flaky graphite, as schematically shown in FIG. 5.

Table 1 shows various properties of the above-mentioned three types of cast iron regions.

TABLE 1

| Type of Cast Iron | FCD | CV | FC |
|---|---|---|---|
| Type of Graphite | Spheroidal Form | Vermicular Form | Flaky Form |
| Ratio of Spheroidal Graphite [%] | 81 | 34 | 0 |
| Tensile Strength [kg/mm$^2$] | 49.1 | 36.5 | 10.5 |
| Elongation [%] | 19.6 | 5.4 | 0.8 |
| Hardness [Hv] | 157 | 145 | 90 |

As evident from Table 1, both the tensile strength and the hardness of the FCD are significantly greater than those of the FC, while the CV has medium properties therebetween. Note the aforementioned "FCHD" is an alloy having a similar property as the "FC".

By rotating the mold at such a relatively high speed as to produce centrifugal force of for example 1000G, the molten metal in the mold cavity can be forced radially outward from the rotational center portion in the mold under the action of centrifugal force and, accordingly, impregnated with the spheroidizing agent under the action of relatively high pressure, with the spheroidizing agent provided at portions where a casting is to be increased in at least mechanical strength and hardness (or abrasion resistance), resulting in the acceleration of reaction of the molten metal with the spheroidizing agent for spheroidizing graphite. In this case, such spheroidizing of graphite in the molten metal can be performed only partially due to relatively small amount of spheroidizing agent and advancement of the solidification of the molten metal.

Accordingly, the casting obtained in accordance with the present invention can have a structure in that the FCD region is gradually transformed at the end thereof into the FC region through the CV region and in that only necessary portions thereof are increased in at least mechanical strength and hardness or abrasion resistance. Further, by the use of a single pouring process for the molten metal, significant elimination and shortening of the casting steps can be achieved, and an easy control of the molten metal is possible.

With the above-mentioned gradual transformation of the cast iron regions, it is possible to prevent poor joint of the cast iron regions including different types of graphite or generation of cracks due to different coefficients of thermal expansion of the respective cast iron regions. This is because there is no definite and clear interface (or boundary) between the different structure-regions.

Further, since the reaction of the molten metal with the spheroidizing agent can be performed under the existence of centrifugal force due to rotation of the mold, gases which may occur during the reaction of the molten metal with the spheroidizing agent can be readily discharged from the casting, resulting in the production of high quality casting having a less porous structure.

Further objects and features of the present invention will become apparent from the following description of the preferred embodiment in conjunction with the attached drawings.

DETAILED DESCRIPTION OF THE PREFERRED EMBODIMENTS

Figure 1:
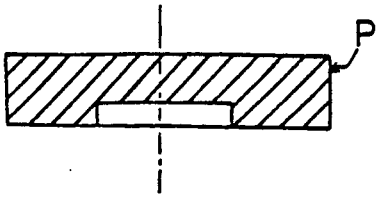
FIG. 1 is a cross-sectional view showing a casting constructed in accordance with one embodiment of the present invention.
Figure 2:
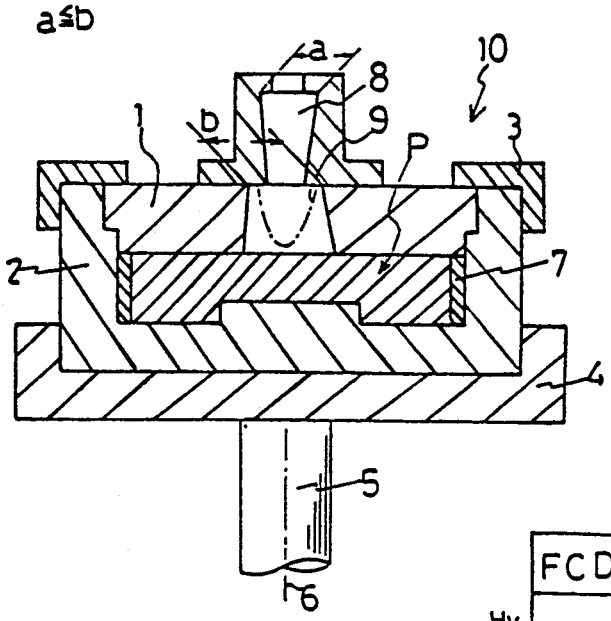
FIG. 2 is a cross-sectional view showing a casting apparatus for producing the casting shown in FIG. 1.

FIG. 1 shows a disk-like casting P as a mechanical part of automobiles which is constructed in accordance with one embodiment of the present invention, and FIG. 2 shows a casting apparatus 10 as an exemplification for producing the casting P shown in FIG. 1 by centrifugal casting.

Referring to FIG. 2, a metallic mold is comprised of an upper and lower molds 1 and 2 which are mated with each other and adapted to be secured by a tightening member 3. A cavity for forming the casting P is defined in the casting mold. The lower mold 2 is securely connected through a rotor 4 to a rotary shaft 5 which is adapted to be rotated about its center axis 6. Disclosed on the upper mold 1 at the center thereof is a hollow pouring gate 8 which is communicated with the mold cavity through a passage formed at the center of upper mold 1. The casting mold is provided on the cylindrical inner wall of the lower mold 2 with a spheroidizing agent 7.

In the particular embodiment, the spheroidizing agent 7 includes particles which are made of an Fe-Si-Mg alloy and which are regulated to have particle sizes which are approximately equal to 35 mesh size. The Fe-Si-Mg alloy may have a Mg content of 4 to 6 weight percent. On the other hand, in the particular embodiment, a molten metal to be used for producing the casting "P" has C, Si, Mn, P (phosphorus) and S contents of, each about, 3.5, 2.4, 0.3, 0.04 and 0.018 weight percent, respectively. The spheroidizing agent 7 provided in the mold cavity is about 0.5 weight percent of the molten metal to be received in the cavity.

After the provision of the spheroidizing agent 7 in the mold cavity, the casting mold is pre-heated at about 300° C., and the casting mold is rotated about the center axis 6 at such a speed as to produce centrifugal force of about 500G at the outer periphery of the mold cavity. In this state, the molten metal having a pouring temperature of about 1400° C. is poured into the cavity through the pouring gate 8. In FIG. 2, the dotted line 9 represents a level contour of the molten metal in the passage of the mold during rotation of the casting mold. As apparent from FIG. 2, it is desirable that the size a of the pouring gate 8 is not greater than the size b of the molten metal ($a \leqq b$).

Figure 4:
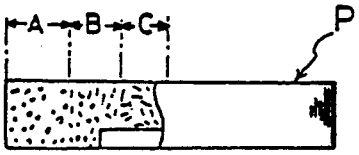
FIG. 4 is a view for schematically showing the internal structure of the casting shown in FIG. 1, including different types of graphite.
Figure 5A:
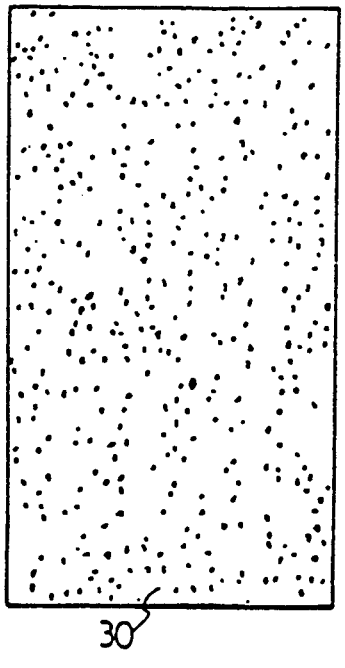
FIG. 5 (A), (B) and (C) are enlarged view of FIG. 4 at different regions of the casting, respectively.
Figure 5B:
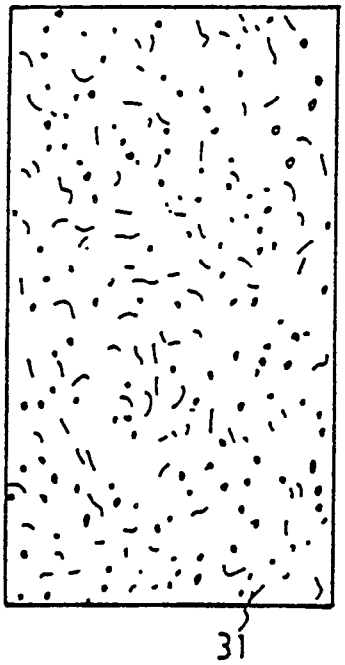
Figure 5C:
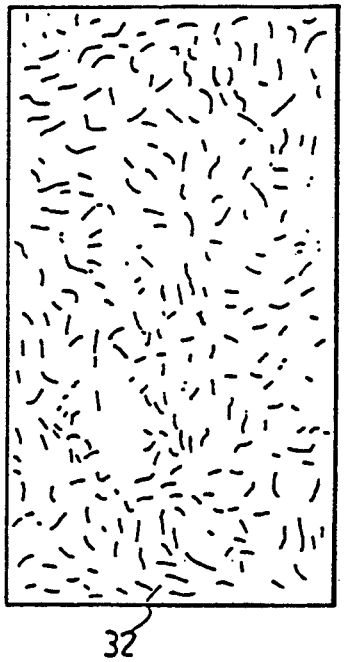
Figure 6:
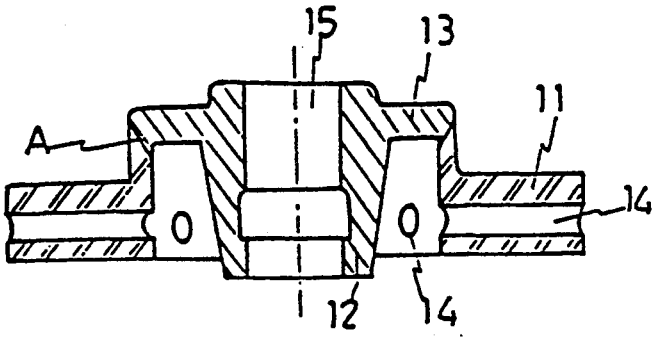
FIG. 6 PRIOR ART
FIG. 6 is a view for explaining the internal structure of a conventional casting.
Figure 7:
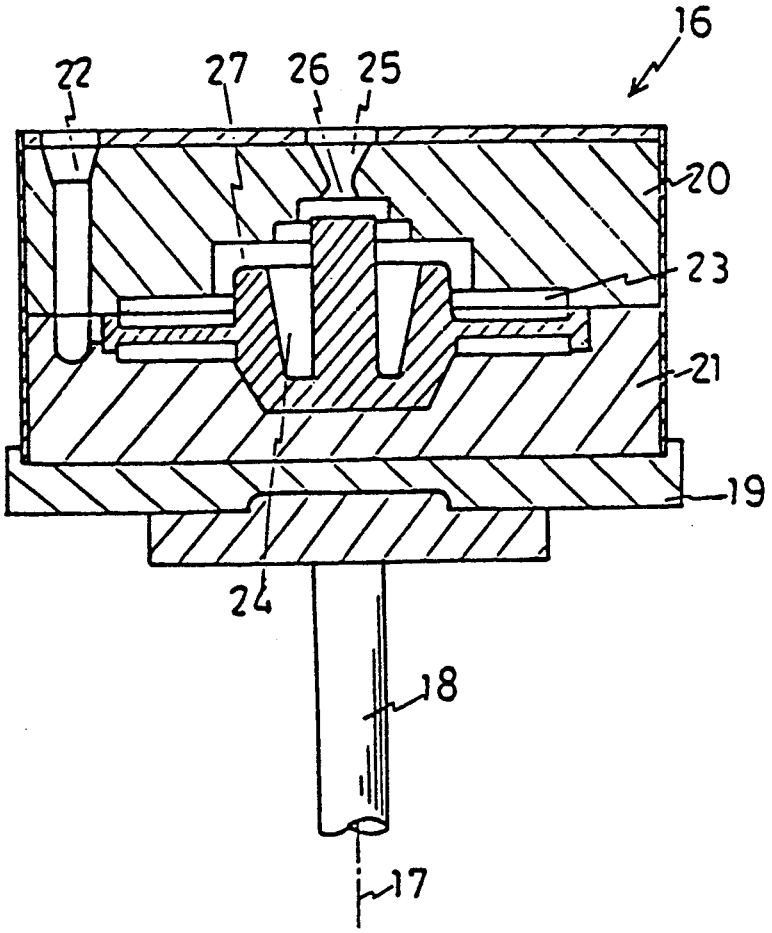
FIG. 7 PRIOR ART
FIG. 7 is a view for explaining a conventional casting apparatus for producing the casting shown in FIG. 6.

FIGS. 4 and 5 shown an internal structure of the casting P produced by the above-described method.

As shown in FIG. 4, the internal structure of the casting P is such that a spheroidal graphite cast iron (FCD) region A, a vermicular graphite cast iron (CV) region B and a gray cast iron (FC) region C are successively arranged from the outer periphery of the casting P to the center thereof. The distribution of graphite in the respective regions A, B and C are illustrated in FIG. 5 (A), (B) and (C), respectively, in the enlarged scale. It will be apparent from FIG. 5 that the FCD region includes the distribution of spheroidal graphite 30, while the CV region includes the distribution of vermicular form graphite 31, and the FC region includes the distribution of flaky form graphite 32. In this embodiment, it was found that each of these regions occupied approximately 30 percent of the whole of the diametric cross section of the casting P, respectively.

Figure 3:
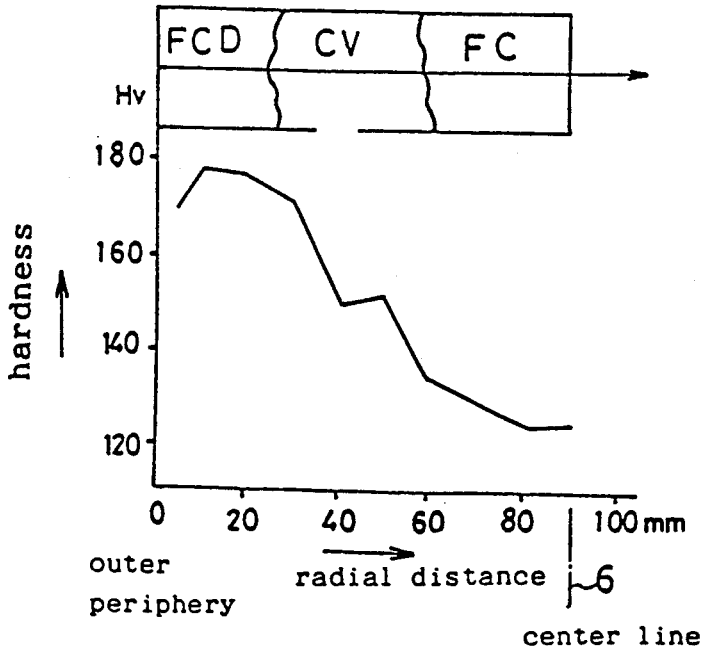
FIG. 3 is a view for explaining the distribution of hardness of the casting shown in FIG. 1 in the radial direction between the center and the outer periphery of the casting.

With respect to the distribution of hardness of the casting P, it was found that the hardness thereof was gradually decreased in the radial direction from the outer periphery of the casting P toward the center thereof, as shown in FIG. 3. In FIG. 3, a point which is apart from the outer periphery of the casting at 90 centimeters is the center of the casting, i.e., the position of the rotational center axis 6 of the casting mold.

Although in the aforementioned embodiment, the spheroidizing agent is put into the mold cavity before pouring of the molten metal, the spheroidizing agent may be provided along with the molten metal into the mold cavity e.g., by coating, spraying or forming in a sheet like fashion the spheroidizing agent so as to be led to portions where a casting is to be increased in, e.g., mechanical strength and hardness or abrasion resistance. Such provision of the spheroidizing agent can produce also the spheroidized region in the casting at the defined position in the casting, the position being defined by the region occupied by the molten metal accompanying the spheroidizing agent.

The disposition of the spheroidized region can be made as follows. For instance, by introducing this agent to the central part of the cavity (or at the intermediate part of the cavity), the spheroidized region can be disposed at the central part (or at the intermediate of the radius, i.e., other than periphery and center). Also the spheroidizing agent can be introduced at a defined partial period of time of the entire pouring period.

While the invention has been described in conjunction with specific embodiments thereof, it is evident that many alternatives and modifications will be apparent to those skilled in the art in light of the foregoing description. Accordingly, it is intended to include all such alternatives and modifications as fall within the spirit and scope of the appended claims.

What is claimed is:

1. A method for producing a casting having at least a disk-like portion having a functional gradient, said disk-like portion comprising a gray cast iron region and a spheroidal graphite region in which the graphite structure is gradually transformed from the spheroidal graphite region toward the gray cast iron region through an intermediate region containing vermicular form graphite, said method comprising the steps of:

providing a mold rotatable about a center axis thereof, said mold being formed therein with a cavity having at least a disk-like portion for receiving molten metal of gray cast iron, and having a pouring gate formed in said mold;

providing spheroidizing agent containing magnesium in said cavity to a position of said disk-like portion where the casting is to be increased in at least one property before pouring the molten metal;

pouring said molten metal into said cavity of said mold through said pouring gate while rotating said mold;

allowing said molten metal in said cavity while rotating said mold to react with said spheroidizing agent under the centrifugal force produced in accordance with the rotation of said mold; and solidifying the reacted molten metal to form said spheroidal graphite region as a radially outermost region, said intermediate region comprising vermicular graphite and said grey cast iron region comprising flaky graphite as an inner region, so that said spheroidal graphite region and said intermediate region are functional gradient oriented in the radial direction resulting from a concentration gradient of the spheroidizing agent.

2. A method according to claim 1, in which the pouring gate is disposed at the center of the mold.

3. A method according to claim 1, in which said spheroidizing agent is set in the cavity.

4. A method according to claim 1, wherein said spheroidizing agent includes particles selected from the group consisting of pure Mg, alloy of Ni-Mg, Cu-Mg or Fe-Si-Mg system, and a mixture thereof.

5. A method according to claim 4, wherein said spheroidizing agent includes alloy of Fe-Si-Mg system having a Mg content of 4 to 6 percent by weight.

6. A method according to claim 1, wherein said spheroidizing agent is provided into said cavity in an amount of 0.2 to 0.8 weight percent, calculated on Mg, of said molten metal occupying said cavity.

7. A method according to claim 1, wherein said mold is pre-heated at 100° to 500° C. when said molten metal having a pouring temperature within the range of 1350° to 1550° C. is poured into said cavity.

8. A method according to claim 1, wherein said mold is rotated at such a speed as to produce a centrifugal force up to 1000G.

9. A method according to claim 8, wherein said mold is rotated at such a speed as to produce a centrifugal force of at least 500G.

10. A method according to claim 1, wherein said intermediate region extends over about 30 percent of the diametric cross section.

11. A method for producing a casting having at least a disk-like portion having a functional gradient, said disk-like portion comprising a gray cast iron region and a spheroidal graphite region in which the graphite structure is gradually transformed from the spheroidal graphite region toward the gray cast iron region through an intermediate region containing vermicular form graphite, said method comprising the steps of:

providing a metallic mold rotatable about a center axis thereof, said mold being formed therein with a cavity having at least a disk-like portion for receiving molten metal made of gray cast iron through a pouring gate formed in said mold;

pouring said molten metal into said cavity of said mold through said pouring gate while rotating said mold;

providing a spheroidizing agent containing magnesium directly in a position in said cavity of said mold across which said molten metal passes so as to provide a concentration gradient of the spheroidizing agent to said position where the casting is to be changed in at least one property;

allowing said molten metal to react in said cavity while rotating said mold with said spheroidizing agent under the centrifugal force produced in accordance with the rotation of said mold; and solidifying the reacted molten metal to form said spheroidal graphite region as a radially outermost region, said intermediate region comprising vermicular graphite and said grey cast iron region comprising flaky graphite as an inner region, so that said spheroidal graphite region and said intermediate region are each disposed circumferentially within said disk-like portion and iron region comprising flaky graphite as an inner region, so that said spheroidal graphite region and said intermediate region are each disposed circumferentially within said disk-like portion and said intermediate region having a functional gradient oriented in the radial direction resulting from the concentration gradient of the spheroidizing agent.

12. A method according to claim 11, wherein said pouring gate is disposed at the center of the mold.

* * * * *

UNITED STATES PATENT AND TRADEMARK OFFICE

CERTIFICATE OF CORRECTION

PATENT NO. : 5,316,068

DATED : May 31, 1994

INVENTOR(S) : Wataru Yagi, et al

It is certified that error appears in the above-indentified patent and that said Letters Patent is hereby corrected as shown below:

On the title page, item [73] Assignee: Please substitute "Aisin Seiki Kabushiki Kaisha, Toyota, Japan" with --Aisin Seiki Kabushiki Kaisha, Kariya; Aisin Takaoka Co., Ltd., Toyota, both of Japan--.

Signed and Sealed this

Seventeenth Day of October, 1995

*Attest:*

Bruce Lehman

BRUCE LEHMAN

*Attesting Officer*

*Commissioner of Patents and Trademarks*